US006640770B2

(12) United States Patent
Woody

(10) Patent No.: US 6,640,770 B2
(45) Date of Patent: Nov. 4, 2003

(54) EVAPORATIVE EMISSION CONTROL APPARATUS FOR A COMBUSTION ENGINE

(75) Inventor: John C. Woody, Caro, MI (US)

(73) Assignee: Walbro Corporation, Cass City, MI (US)

( * ) Notice: Subject to any disclaimer, the term of this patent is extended or adjusted under 35 U.S.C. 154(b) by 86 days.

(21) Appl. No.: 09/970,932

(22) Filed: Oct. 4, 2001

(65) Prior Publication Data

US 2003/0066505 A1 Apr. 10, 2003

(51) Int. Cl.[7] ..... F02B 77/00

(52) U.S. Cl. ..... 123/198 D; 123/198 BD

(58) Field of Search ..... 123/198 D, 198 DB, 123/325

(56) References Cited

U.S. PATENT DOCUMENTS 3,601,107 A * 8/1971 Rohrbacher et al. ..... 123/517
5,906,189 A * 5/1999 Mukai et al. ..... 123/519

* cited by examiner

*Primary Examiner*—Tony M. Argenbright
*Assistant Examiner*—Katrina B. Harris
(74) *Attorney, Agent, or Firm*—Reising Ethington Barnes Kisselle, P.C.

(57) ABSTRACT

A fuel evaporative emission control apparatus in a carburetor which prevents diurnal evaporation to the atmosphere of fuel from a remote fuel tank through a fuel bowl or fuel chamber of a float-type carburetor. One or more shut-off valves in the carburetor are yieldably biased to a shut-off position. Only upon engine operation or user intervention will the fuel shut-off valve move to an open or on position. In this way, reliance upon the engine user is not required to reduce evaporative emissions.

34 Claims, 9 Drawing Sheets

EVAPORATIVE EMISSION CONTROL APPARATUS FOR A COMBUSTION ENGINE

FIELD OF THE INVENTION

This invention relates to an evaporative emission control apparatus for a combustion engine and more particularly to a fuel evaporative emission control apparatus having a carburetor fuel shut-off valve.

BACKGROUND OF THE INVENTION

The California Air Resources Board, CARB, and the United States Environmental Protection Agency, EPA, have been monitoring and regulating the emissions of automobile and non-automobile engines for decades. A source of air born pollution, notably hydrocarbons, has recently been the subject of proposed regulation by CARB. The source is diurnal emissions from lawn and garden equipment such as walk behind lawn mowers, tillers and garden tractors. The vast majority of this equipment is powered by small two and four stroke engines, which use two-way vented gas tanks and either float-bowl or diaphragm carburetors. The hydrocarbon emissions come from the evaporation of gasoline vented to the atmosphere. This equipment is often stored in sheds which are poorly ventilated producing high temperature conditions in excess of one hundred and twenty degrees Fahrenheit (120° F.) and/or are often exposed to direct sunlight in the summer.

To reduce evaporation of fuel from this equipment, outward movement of air and fuel vapor from the fuel tank must be prevented. This is already common on hand held equipment powered by two stroke engines, such as string trimmers, blowers hedge trimmers, etc. In the case of handheld equipment, this is done to prevent gasoline from exiting the tank when the equipment is held in an attitude such that the vent is below the level of fuel in the tank and there is a positive pressure in the tank. The positive pressure is common and is caused by a temperature increase in the fuel or vibration of the gas tank. In addition to sealed gas tanks on handheld equipment, the vast majority of this equipment employs two stroke engines with sealed crankcases and diaphragm type carburetors. Interestingly, this handheld equipment produces much less evaporative emissions than the non-handheld equipment utilizing float-bowl carburetors, and CARB is proposing only a less permeable gas tank material for this equipment. Unfortunately, diaphragm carburetors are not practical for all applications. They have limited fuel metering and vapor vent capability which can lead to engine instability and vapor lock conditions.

Float-bowl carburetors on the other hand have higher fuel metering capability and are commonly used on engines powering non-handheld lawn and garden equipment. The float-bowl carburetor is a relatively simple mechanical device and is known for high evaporative emissions. The float-bowl carburetors used on the smaller engines such as walk behind lawn mowers are the simplest of all. They do not utilize fuel pumps, mounting the gas tank above the carburetor and relying on gravity to feed the fuel. These carburetors do not even have an idle system and the engine operates at a relatively constant speed from no load to full load operation. Cost is a major driver in this market as there are many competitors chasing this multi-million engine per year market. These engines also employ the simplest of ignition systems with electric power generated only for the ignition to fire the spark plug. Therefore, a solution to reduce evaporative emissions should be simple, mechanical and cost effective to be viable for this market.

The diaphragm type carburetors in use today on most hand held equipment, by their design, do not allow the passage of fuel from the gas tank into the metering chamber of the carburetor unless the engine is running and there is sufficient vacuum generated in the carburetor metering chamber to depress the metering diaphragm that opens the spring bias closed inlet valve. The inlet valve is spring loaded closed and it is common that it will remain closed against inlet pressures exceeding twenty psi. By contrast, the typical float-bowl carburetor has an inlet valve which is normally biased open unless the float bowl is completely full of fuel thus closing the valve. The volume of fuel contained in a typical float bowl is several time greater than that of the metering chamber of a diaphragm type carburetor. The gasoline commonly used today evaporates over a wide temperature range starting at around ninety degrees Fahrenheit (90° F.) with approximately thirty percent (by volume) gone by one hundred sixty degrees Fahrenheit (160° F.) and ninety plus percent (by volume) gone at three hundred fifty degrees Fahrenheit (350° F.).

When a piece of lawn and garden equipment is shut down after a sufficient amount of running time that the engine is at normal hot operating temperatures, the first thing that happens (over thirty minutes) is that heat is transferred from the cylinder head of the engine thru the intake manifold to the carburetor. The carburetor, which may have been at a sub-ambient temperature while running due to the cooling effect of the vaporization of the gasoline in the venturi heats up. The fuel that is in the metering chamber of a diaphragm carburetor or the float bowl of a float carburetor evaporates by a volume percent dependent on the highest temperature reached, and from this point the temperatures of the entire piece of equipment cools to ambient. Now the equipment is placed in a lawn shed with limited ventilation. Assume the temperature fluctuates over a twenty-four hour period from a daytime high of one hundred twenty degrees Fahrenheit to a nighttime low of sixty degrees Fahrenheit. First consider the equipment with the diaphragm type carburetor. Assume that the carburetor reached a temperature in excess of one hundred twenty degrees Fahrenheit after the equipment shutdown. A percentage of fuel in the metering chamber would evaporate and go into the atmosphere (say twenty percent (by volume)). Since the engine is not started during storage, the twenty percent of the fuel lost from the metering chamber after shut down is not replaced from the tank. During the diurnal temperature swings, since the daytime temperature does not exceed the initial temperature, no further fuel is evaporated, even if the daytime temperature does exceed the previous high, the evaporation loss is only the percent difference between the previous and the new high.

Now consider a typical float-bowl carburetor, with the same temperatures, during the initial heat and soak back from the engine to the carburetor, twenty percent of the fuel in the bowl evaporates into the atmosphere. This is a greater amount of fuel loss than the diaphragm carburetor due to the fact that the float bowl held more fuel than the diaphragm chamber. To further aggravate matters, when the fuel evaporates the float drops allowing fresh fuel from the sealed gas tank to replace the evaporated fuel. This will continue with each subsequent temperature rise until the entire float bowl is filled with fuel that does not evaporate at the highest temperature reached. Therefore to minimize the loss of fuel due to evaporation from a float-bowl carburetor, refilling of the float bowl with fuel must be prohibited and preferably, the volume of fuel in the bowl should be minimized. A manual shut-off valve at the bottom of the fuel tank or at the fuel inlet of the carburetor is common, however not sufficient because there is no assurance that the ordinary user of the lawn and garden equipment will close the valve on shutdown.

SUMMARY OF THE INVENTION

This invention provides a fuel evaporative emission control apparatus which prevents the diurnal evaporation and exposure to the atmosphere of fuel from a remote fuel tank via a fuel bowl or fuel chamber of a float-type carburetor. A fuel shut-off valve is mounted on the float-type carburetor and preferably a bowl vent shut-off valve is installed in the bowl vent passage of the carburetor with both valves biased to their shut-off position when the engine is not being cranked or running. Only upon engine operation or user intervention can the shut-off valves move from the biased off position to an open position. In this way, reliance upon the user is not required to reduce evaporative emissions.

The fuel shut-off valve is part of a carburetor body and has a recess between the carburetor body and a lid of the shut-off valve. A valve head is received in the recess and obstructs communication between an inlet aperture and outlet aperture communicating with the recess. A fuel-in passage communicates between the inlet aperture and an external carburetor fuel inlet which leads to the external fuel tank. A fuel-out passage communicates between the outlet aperture and the fuel chamber.

Preferably, the bowl vent shut-off valve has a ball disposed in a counterbore carried by the carburetor body. The ball, via gravity, seats against a seat insert press fitted into the counterbore, thereby preventing fuel evaporation and escape through the vent passage from the float bowl.

A float is disposed within the fuel chamber and operates a needle valve to close the fuel-out passage when the fuel chamber is full, and to open the fuel-out passage when the fuel level within the chamber is low. The shut-off valve operates to isolate the fuel-in passage from the fuel-out passage regardless of the needle float position when the engine is not running. In this way, evaporation and escape to the atmosphere of fuel contained in the remote fuel tank of a non-running engine is prohibited.

Objects, features and advantages of this invention include providing an evaporative emission control apparatus which limits evaporative emissions, does not require operator intervention to activate it, has an extremely compact construction and arrangement, is of relatively simple design, extremely low cost when mass produced and is rugged, durable, reliable, requires little to no maintenance and in service has a long useful life.

BRIEF DESCRIPTION OF THE DRAWINGS

These and other objects, features and advantages of this invention will be apparent from the following detailed description, appended claims and accompanying drawings in which:

DETAILED DESCRIPTION OF THE PREFERRED EMBODIMENTS

Figure 1:
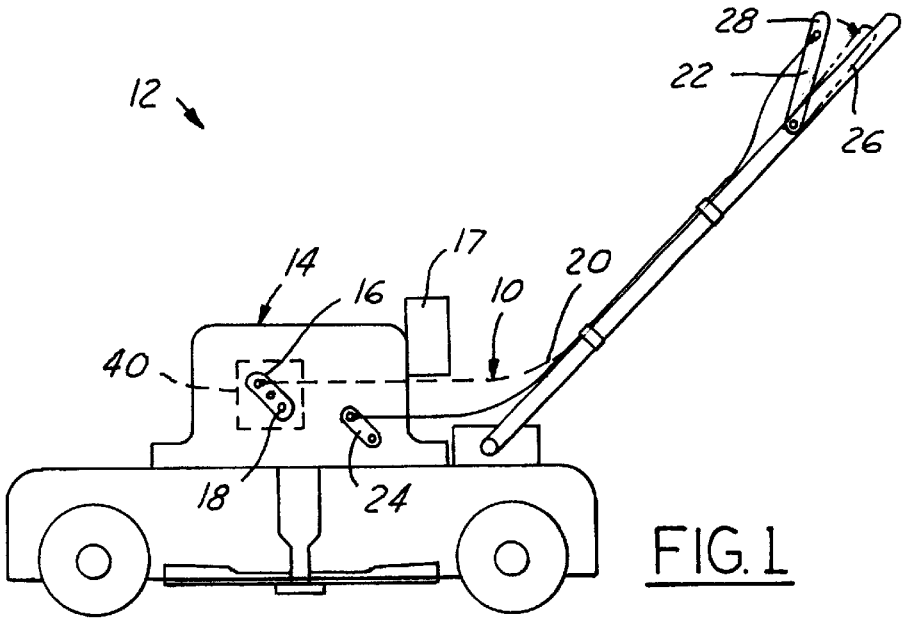
FIG. 1 is a perspective view a lawn mower having an evaporative emission control apparatus of the present invention.

Referring in more detail to the drawings, FIG. 1 illustrates an evaporative emission control apparatus 10 embodying this invention on a push or walk behind lawn mower 12 having a combustion engine 14. A fuel shut-off valve 16 of the emission control apparatus 10 prevents the flow of fuel from a remote fuel tank 17 to a carburetor 40 when the engine 14 is shut down. The shut-off valve 16 is actuated by a pivoting arm 18 which is controlled by the user via a push-pull cable 20 connected to a safety lever 22. The push-pull cable 20 is further spliced in order to engage a pivoting ignition cut-off arm or switch 24. In other words, the emission control apparatus is actuated by the ignition cut-off apparatus of the lawn mower 12 so that when the user releases the spring biased safety lever 22, the safety lever pivots from a run position 26 to a biased shut-down position 28. The safety lever 22 or apparatus is spring-loaded, or biased so that the user must actively or consciously continuously hold the safety lever 22 in the run position 26 or the lawn mower engine 14 will cease to operate.

Figure 2:
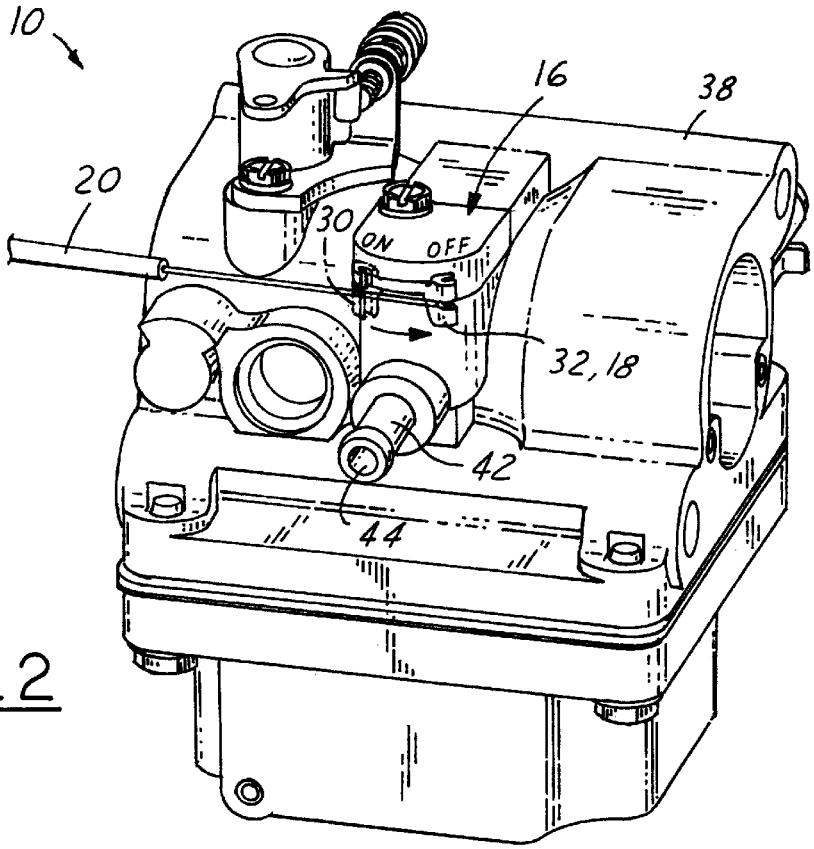
FIG. 2 is a perspective view of a carburetor having an integrated fuel shut-off valve of the emission control apparatus.
Figure 3:
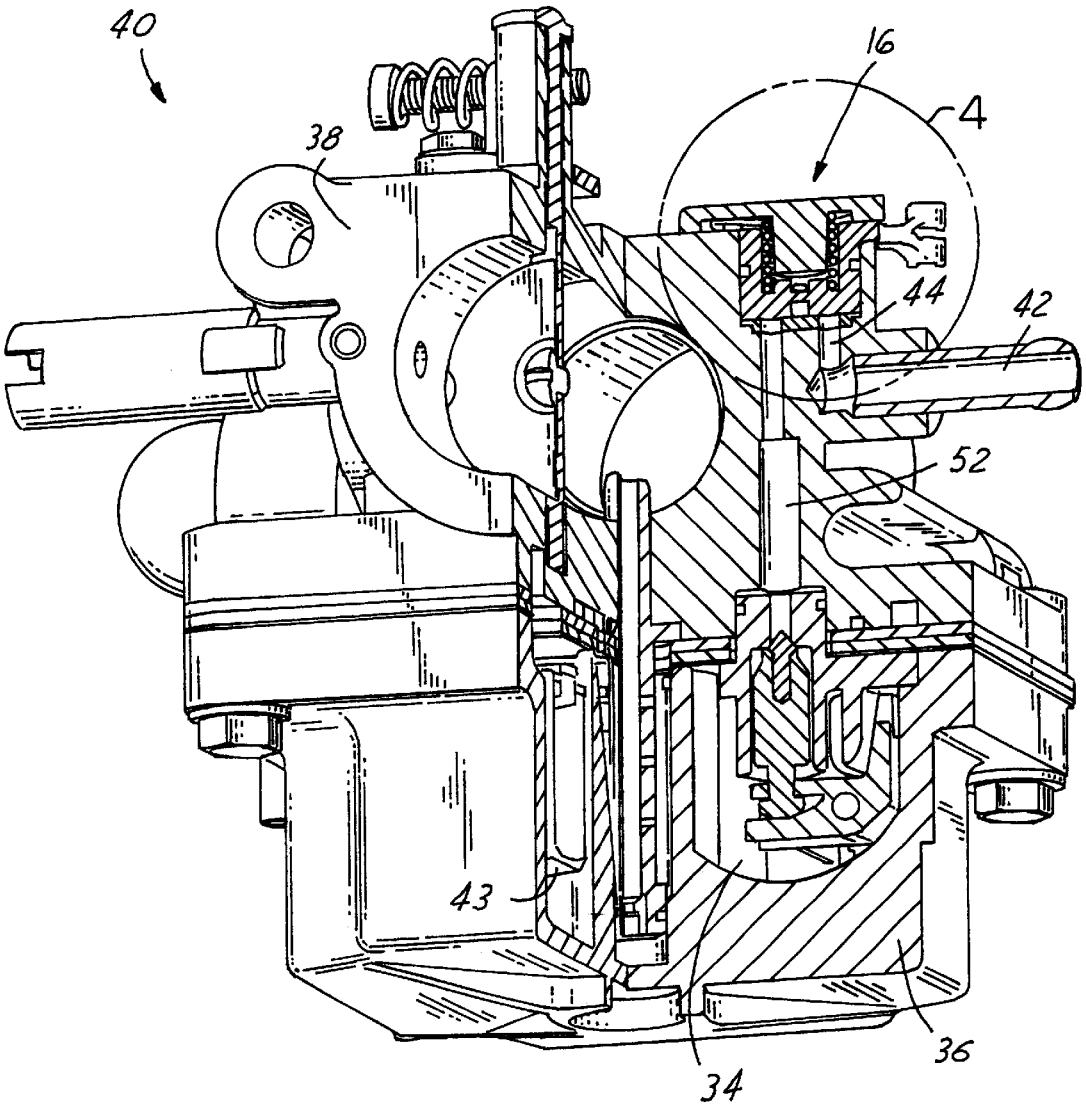
FIG. 3 is a perspective view of the carburetor with portions broken away and in section to show internal detail.

Referring to FIGS. 1–3, fuel flows from the remote fuel tank 17 to the carburetor 40 via a fuel passage bisected into a fuel-in passage 44 and a fuel-out passage 52 by the fuel shut-off valve 16. The fuel-out passage 52 communicates between a fuel chamber 34, defined by a fuel bowl 36 engaged to the underside of a carburetor body 38 of the carburetor 40, and the shut-off valve 16. The fuel-in passage 44 communicates between the shut-off valve 16 and the remote fuel tank 17 which is located at an elevation higher than the carburetor 40. Fuel flows to the fuel chamber 34 from the remote tank 17 via gravity through an external carburetor inlet or nipple 42 connected to the fuel-in passage 44. The fuel then flows through the valve 16 when open and through the fuel-out passage 52 defined by the carburetor body 38. The passage 52 communicates with a needle valve 41 actuated by a float 43 disposed within the fuel chamber 34 which generally floats on liquid fuel within the chamber. As fuel in the bowl 36 is depleted via combustion or evaporation, the float 43 lowers within the fuel chamber 34 thereby opening the valve 41 so that fuel from passage 52 flows into the chamber 34 until the float 43, once again, rises sufficiently to close the valve 41 and hence the overhead fuel-out passage 52. This replenishing fuel flow, however, only occurs if the safety lever 22 is in the run position 26. If the safety lever 22 is in the shut-down position 28, the fuel shut-off valve 16 is closed and prevents or obstructs communication between the fuel-in and fuel-out passages 44, 52 preventing fuel flow into the fuel chamber 34. In this way, evaporative, emissions from a non-operating combustion engine are greatly reduced.

Figure 4:
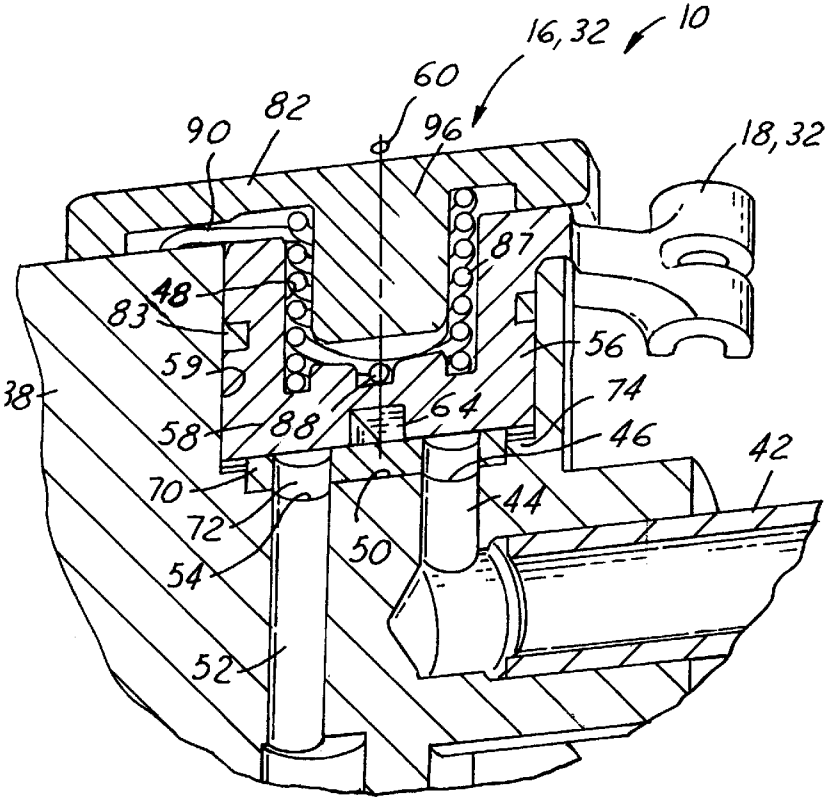
FIG. 4 is an enlarged fragmentary cross section view of a shut-off valve shown in an off position and taken from FIG. 3.
Figure 5:
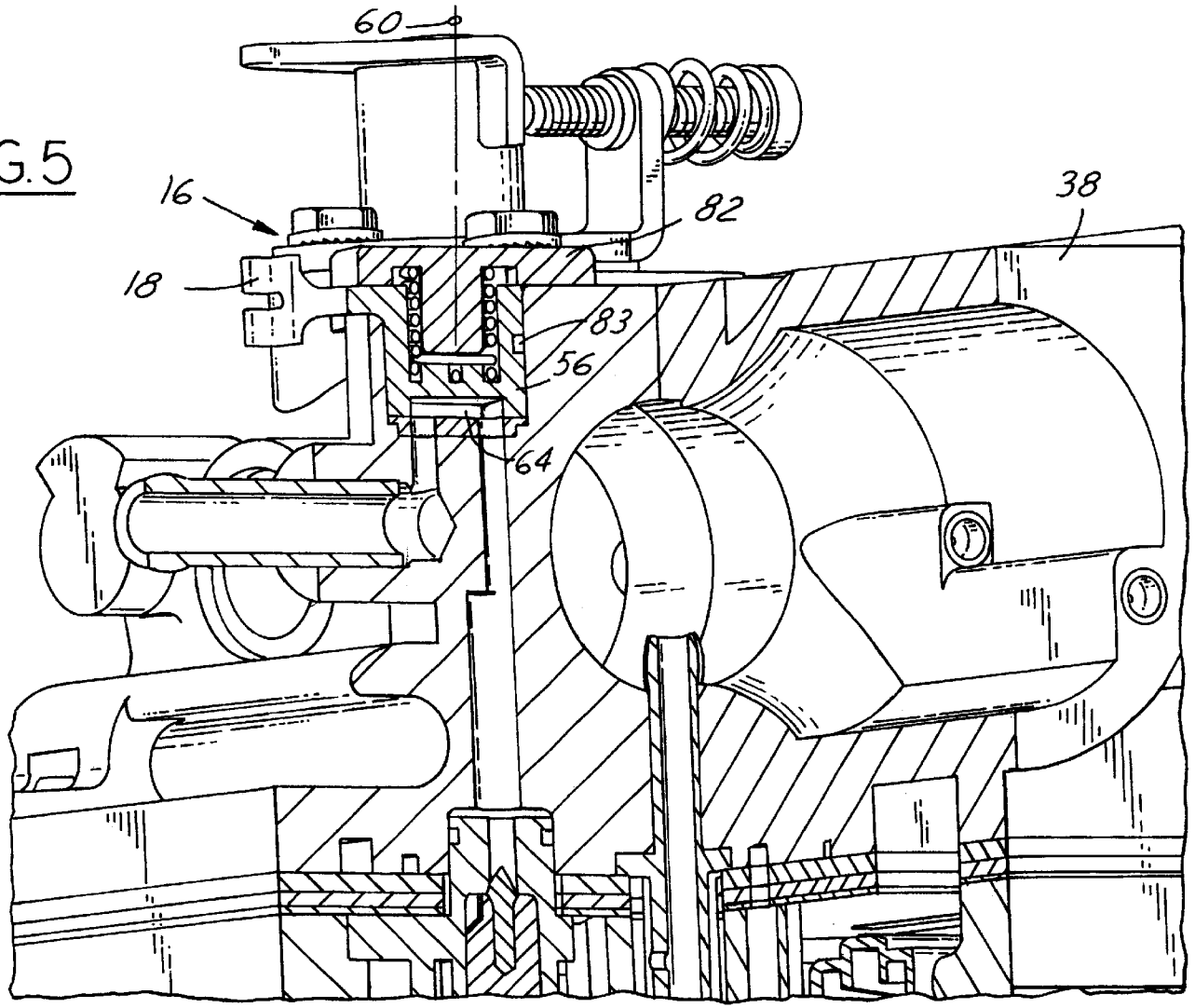
FIG. 5 is a fragmentary perspective view of the carburetor with portions broken away and in section to show internal detail and with the shut-off valve shown in an on position.

Referring to FIGS. 1–7, when the safety lever 22 moves from the run position 26 to the shut-down position 28, the push-pull cable 20 moves or pivots the arm 18 from an on position 30 (as best shown in FIG. 5) to an off position 32 (as best shown in FIG. 4). When the shut-off valve 16 is in the on position 30, fuel flows freely from the external fuel tank 17 thru the external carburetor inlet or nipple 42 of the fuel-in passage 44 which extends from the nipple 42 to an inlet aperture 46 communicating with a recess or blind bore 48 of the shut-off valve 16 in the carburetor body 38. The inlet aperture 46 is defined by a valve seat or mating surface 50. Communicating between the blind bore 48 and the fuel chamber 34 is the fuel-out passage 52 in the carburetor body 38. The fuel-out passage 52 communicates thru an outlet aperture 54 defined by the valve seat 50, or bottom of the blind bore 48. Thru these passages, the external fuel tank is exposed to the fuel chamber 34 when the shut-off valve 16 is in the open or on position 30. This exposure is necessary for a running engine requiring the high fuel flow of a float-bowl carburetor, but can promote evaporative emissions without the emission control apparatus 10.

When the shut-off valve 16 is in the off or closed position 32, an obstruction valve head 56 closes or seals off the fuel-in passage 44 from the fuel-out passage 52, and hence the external fuel tank 17 is not connected to the fuel chamber 34, and therefore is no longer capable of supplying fuel to the fuel chamber 34.

Figure 7:
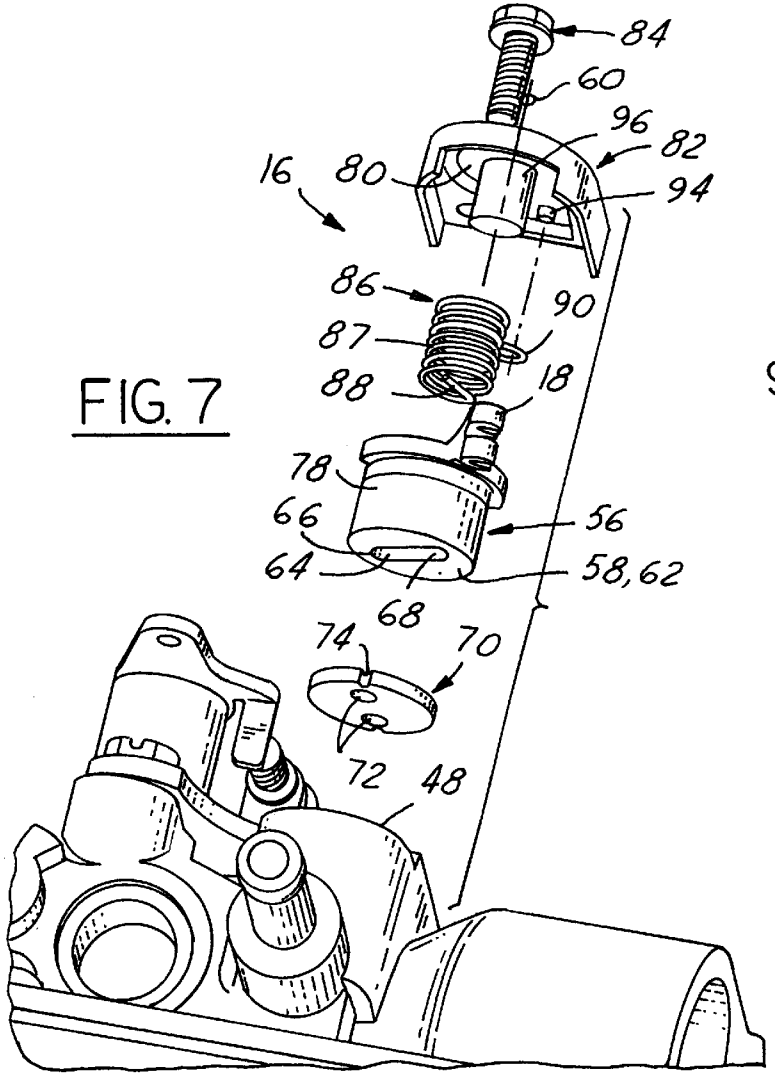
FIG. 7 is an exploded and fragmentary bottom perspective view of the fuel shut-off valve.

Referring to FIGS. 5 and 7, the valve head 56 has an integral arm 18 and a lower body portion 58 received in the blind bore 48 in the body 38 and rotatable about a common centerline 60 of the shut-off valve 16. The body or cylindrical portion 58 has a substantially planar bottom surface 62 which faces the apertures 46, 54. When the shut-off valve 16 is in the open position 30, a blind groove or bottom channel 64 in the bottom surface 62 has a first end 66 which communicates with the inlet aperture 46 and an opposite second end 68 which communicates with the outlet aperture 54 to interconnect the apertures. The bottom channel 64 has a width which is substantially less than the distance between the inlet and outlet apertures 46, 54 so that an approximate ninety degree rotation of the shut-off valve 16 about the centerline 60 from the open position 30 to the closed position 32 will cause the inward channel 64 to lie between the apertures 46, 54 and not communicate with either of them.

Located axially between the seat 50 of the carburetor body 38 and the bottom surface 62 of the valve head 56 is a gasket 70. The gasket 70 has two holes 72 which align with or communicate between the respective apertures 46, 54 and the first and second ends 66, 68 of the bottom channel 64 when the shut-off valve 16 is in the open position 30. The gasket 70 is stationary with respect to the carburetor body 38 and is held in place by notches 74 disposed about the perimeter of the substantially round gasket 70 and complimentary detents in the bore or recess 48. Both sides of the gasket 70 seal directly between the seat 50 and the bottom surface 62 of the valve head 56.

Figure 6:
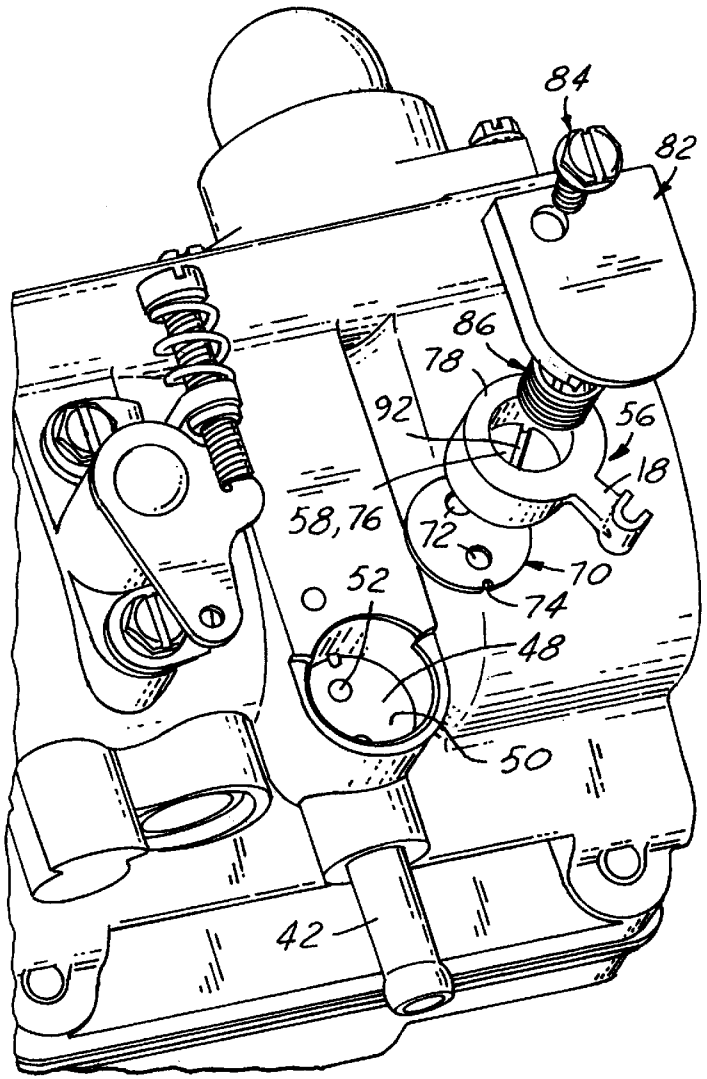
FIG. 6 is an exploded and fragmentary top perspective view of the fuel shut-off valve.

As shown in FIGS. 4 and 6, the arm 18 of the valve head 56 extends radially or laterally outward thru a slot 80 defined between the carburetor body 38 and a lid 82 of the fuel shut-off valve 16. The slot 80 extends circumferentially about the bore 48 through an arc greater or equal to about ninety degrees. The lid 82 covers the bore 48, overlies and entraps the valve head 56, and is secured to the carburetor body 38 by a fastener or threaded bolt 84. To provide a secondary air tight seal between the carburetor body and the valve head 56, an o-ring or seal is received in a radially outward opening circumferential groove 83 in the cylindrical body portion 58 of the valve head 56 and slideably engages the cylindrical wall of the carburetor body 38 which defines the blind bore 48.

To bias the shut-off valve 16 toward its off position 32 and to provide a downward sealing force to valve head 56, a spring 86 is received in the blind bore 48 in the cylindrical body portion 58 of the valve head, and over a cylindrical stud 96 projecting downward from the lid 82 and disposed concentrically about the center line 60. The spring 86 has a central coil portion 87, a first end 88 received in a slot 92 in the valve head 56 and a second end 90 with a hook bearing on a pin 94 integral with the lid 82, thereby causing the coil portion 87 to coil or wind up when the valve 16 is rotated from its off position 32 to its on position 30 and to re-coil or unwind in the reverse direction insuring that the valve 16 is in the closed position when lever 22 is in the shutdown position. The stud 96 locates and stabilizes the spring 86 within the bore 48 and prevents disengagement from the ends. The radial clearance between carburetor body 38 and the valve head 56 is large enough to ensure rotation of the valve head 56 yet tight enough to provide a stable, long lasting and reliable, shut-off valve 16.

Figure 8:
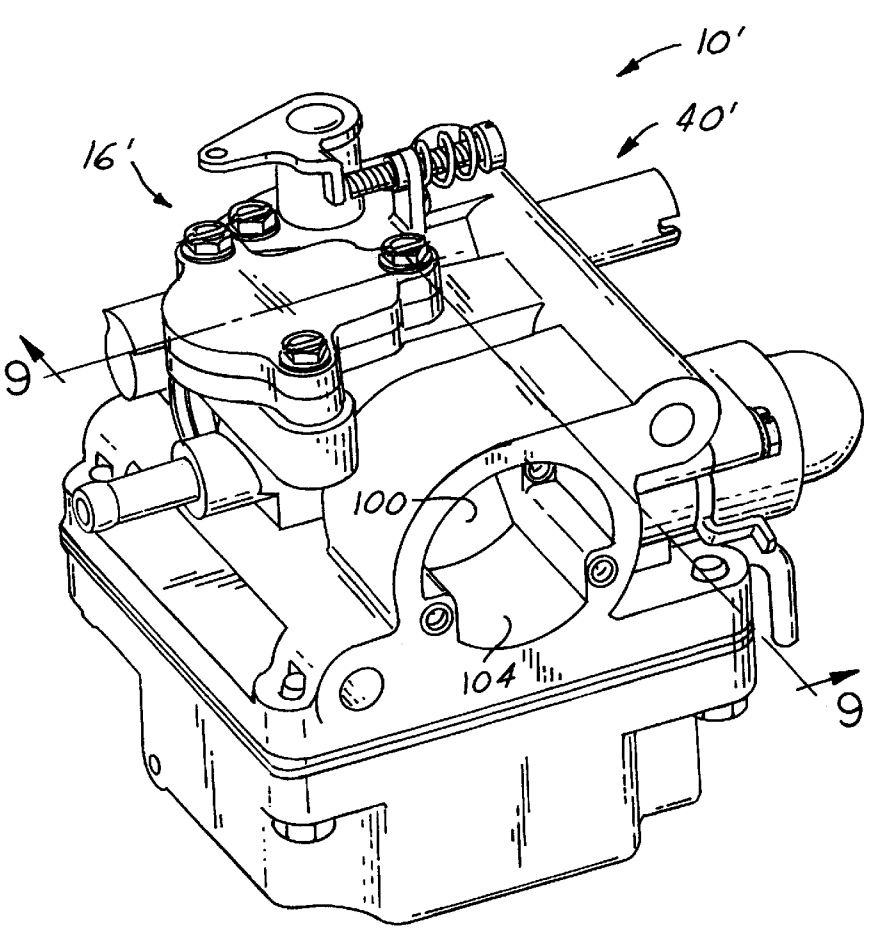
FIG. 8 is a perspective view of a second embodiment of an evaporative emission control apparatus on a carburetor.
Figure 9:
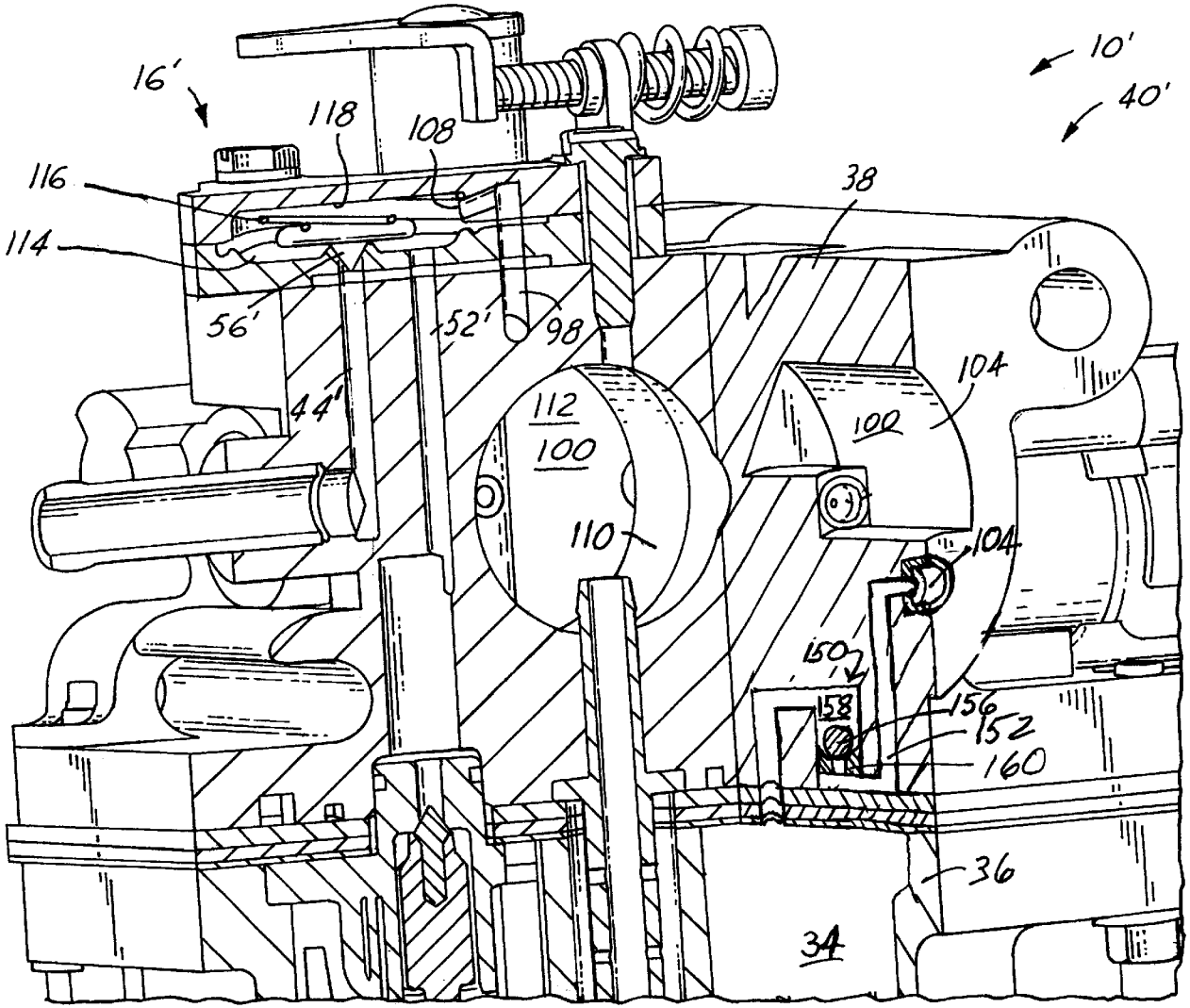
FIG. 9 is a fragmentary perspective view of the emission control apparatus of FIG. 8 with portions broken away and in section to show internal detail.
Figure 10:
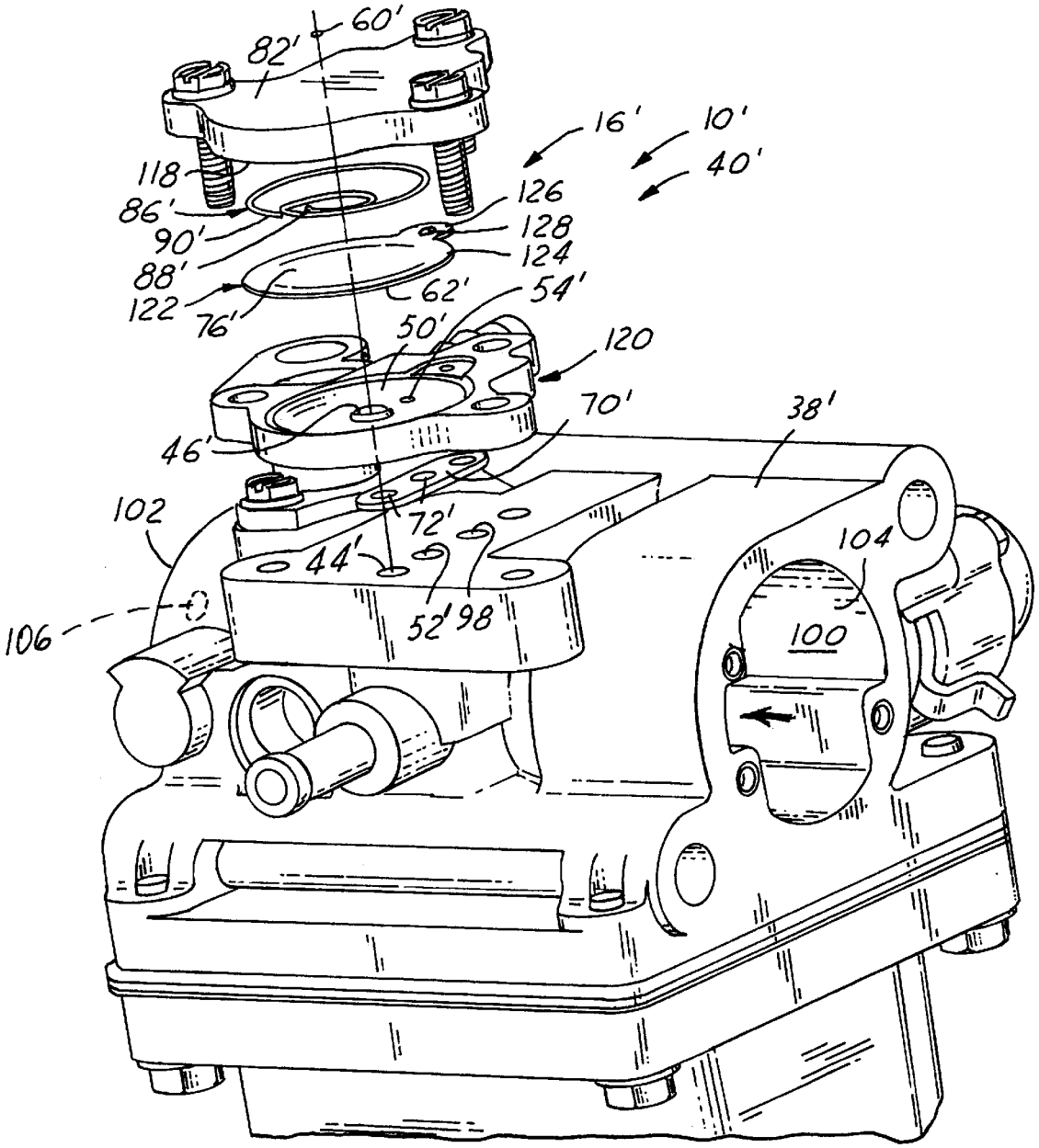
FIG. 10 is an exploded and fragmentary perspective view of the second embodiment of the emission control apparatus.

FIGS. 8–10 illustrate a second embodiment of the emission control apparatus 10' which does not require user intervention and therefore does not require the lever arm 18, push-pull cable 20 and safety lever 22 of the first embodiment 10. Rather, apparatus 10' has a normally closed fuel shut-off valve 16' which is actuated or opened by a sub-atmospheric pressure or vacuum exerted upon a flexible diaphragm 122 which carries a valve head 56'. The vacuum source can be from a variety of locations within a cranking or running engine such as the intake manifold or crankcase. The emission control apparatus 10' as illustrated has a vacuum passage 98 which communicates between a blind bore or cavity 48' of the shut-off valve 16' and a fuel-and-air mixing passage 100 which extends thru the carburetor 40' from an inlet 104 at or near atmospheric pressure to an outlet 102 disposed upstream of the combustion chamber of the engine 14' at or near the intake manifold. The vacuum passage 98 extends between a vacuum source or orifice 106 disposed near the outlet 102 of the fuel-and-air mixing passage 100 and a vacuum port 108 in a lid 82' of the shut-of valve 16'. During operation of the combustion engine 14', air is drawn thru the fuel-and-air mixing passage 100 from an external air filter disposed at or near the inlet 104 thru a venturi 110 defined by the carburetor body 38' within the fuel-and-air mixing passage 100, past a control throttle plate 112 disposed between the venturi 110 and outlet 102, through the outlet 102 and into the combustion chamber (not shown) of the combustion engine 14'. A main fuel feed tube 114 projects upward and thereby communicates between the fuel chamber 34' and the fuel-and-air mixing passage 100 at or near the venturi 110. Because the pressure within the fuel-and-air mixing passage 100 at or near the venturi 110 is lower than the pressure within the fuel chamber 34', fuel flows from the chamber 34' into the fuel and air mixing passage 100.

The vacuum orifice 106 is disposed at or near the outlet 102 downstream of the throttle plate 112. At this point the vacuum is relatively high and has the greatest effect on the shut-off valve 16'.

The valve head 56' is a conical tip projecting downward from the diaphragm and concentrically disposed about the centerline 60'. The recess 48' is divided by the diaphragm 122 into an inner chamber 114 and an outer chamber 116. The inner chamber 114 is defined by an inward surface 62' of the diaphragm 122 and the valve seat 50' of a plate 120 of the carburetor body 38'. The outer chamber 116 is defined between an outward surface 76' of the diaphragm 122 and a recess 118 of the lid 82'. The vacuum passage 98 communicates through port 108 between the outer chamber 116 and the portion of the fuel-and-air mixing passage 100 disposed downstream of the throttle plate 112. When the combustion engine 14' is in operation, the outward chamber 116 is under vacuum or sub-atmospheric pressure communicated through the vacuum passage 98. The resilient diaphragm 122 is thereby forced or flexed axially outward along a centerline 60' thereby positioning the shut-off valve 16' in the open position 30' (not shown) in which the tip 56' is disengaged and spaced from its associated seat 50'.

To open the valve 16', the force created by the differential pressure across the diaphragm 122 must be great enough to overcome the biasing force of a spring 86' disposed in the outer chamber 116. The spring 86' is a coiled compression spring which is in an axially compressed state when the shut-off valve 16' is in the open position 30'. A first end 88' of the spring member 86' bears on the diaphragm 56' and a second end 90' bears on the inward surface 118' of the lid 82'.

The intermediate plate 120 of the shut-off valve 16' is engaged between the lid 82' and the carburetor body 38'. The intermediate plate 120 is a non-unitary or separate part of the carburetor body 38' so that the cavity 50' is defined by the intermediate plate 120. A gasket 70' is engaged sealably and directly between the carburetor body 38' and the intermediate plate 120. The gasket 70' has three holes 72' permitting communication of a fuel-in, a fuel-out, and vacuum passages 44', 52', 98 thru the gasket 70' and thru the intermediate plate 120.

The fuel-in passage 44' is substantially orientated concentrically about the centerline 60'. The cone tip 56' of the diaphragm 122 projects downward into the fuel-in passage 44' from the inward surface 62 of the diaphragm 122. The cone tip 56' is of a resilient material and sealably engages the seat 50' which defines the aperture 46' of the fuel-in passage 44'. The diaphragm 122 has a perimeter or circumferential edge 124 which is compressed sealably between the intermediate plate 120 and the lid 82'. Projecting radially and unitarily from the diaphragm member 122, or from the circumferential edge 124, is a planar tab portion 126. Tab portion 126 also has a hole 128 which permits communication of the vacuum passage 98 from the intermediate plate 120 to the lid 82'.

When the combustion engine 14' is shut down or not operating the shut-off valve 16' moves to an off position 32'. Movement to the off position 32' is caused when the vacuum within the outer chamber 116 is relieved and the bias of the spring member 86' pushes the diaphragm 122 downward so that the cone tip 56' sealably bears on the seat 50' of the fuel-in passage 44'.

Figure 11:
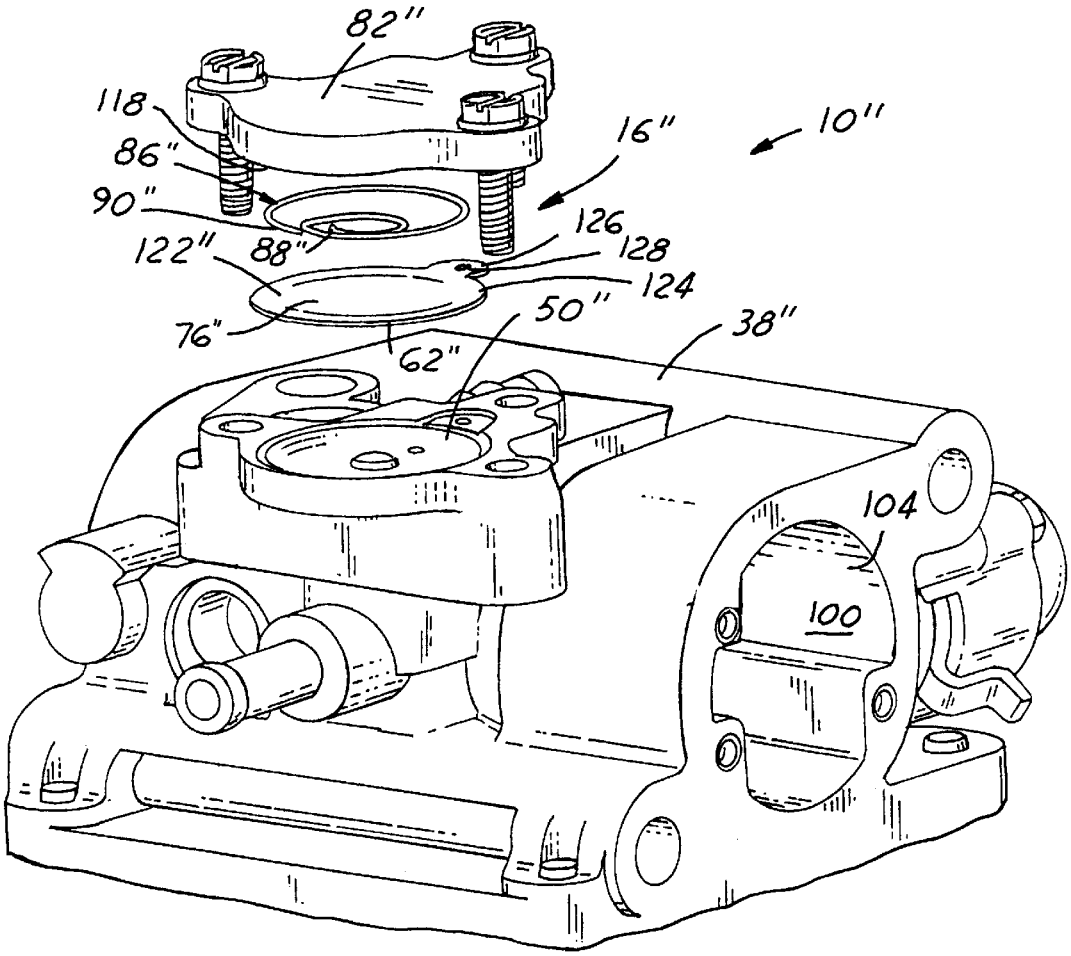
FIG. 11 is an exploded and fragmentary perspective view of a third embodiment of the emission control apparatus.

FIG. 11 illustrates a third embodiment of the present invention of an emission control apparatus 10" which is similar to the second embodiment 10' except the intermediate plate 120 and the gasket 70' are no longer required. The recess 50" is formed directly in the carburetor body 38". The diaphragm 122" is thereby engaged directly between the lid 82" and carburetor body 38". While in the second embodiment of the emission control apparatus 10' the shut-off valve 16' could be attached to the carburetor body 38' as a modular unit, in the third embodiment of the emission control apparatus 10", fewer parts are required, however, the shut-off valve 16" must be assembled directly to the carburetor body 38".

Figure 12:
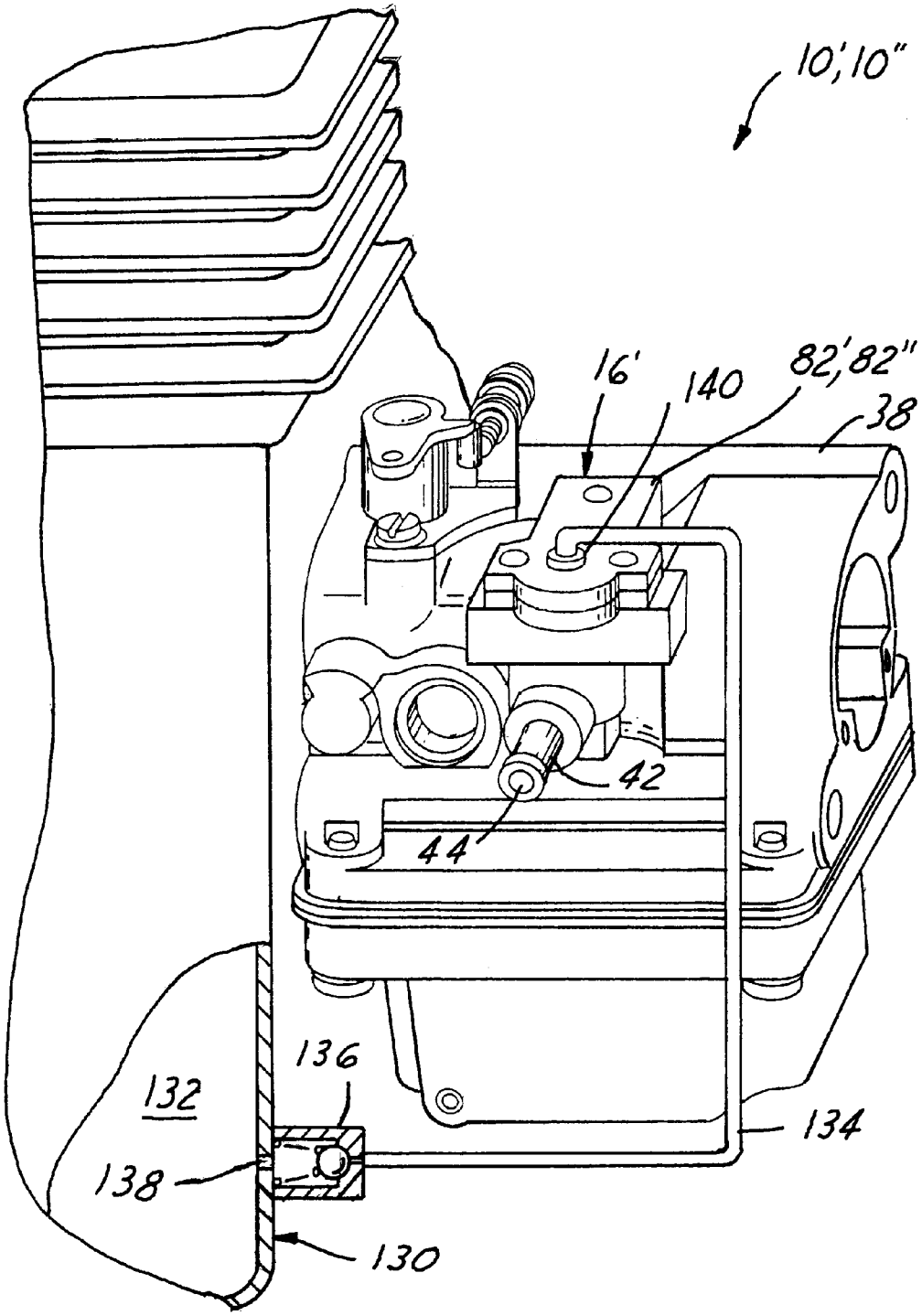
FIG. 12 is a fragmentary perspective view illustrating a modification of the second and third embodiments in which sub-atmospheric pressure pulses produced in the crankcase of an operating engine are utilized to actuate and control the shut-off valve of the evaporative emission control apparatus on the carburetor.

As shown in FIG. 12, the normally closed fuel shut-off valve 16' of the emission control apparatus 10' and 10" can be actuated to open the valve 16' by applying to its chamber 116 and diaphragm 122, 122' the sub-atmospheric or vacuum pressure pulses created in a crankcase 132 of an operating engine 130 on which the carburetor is being utilized. The carburetor is slightly modified so that rather than communicating with the fuel and air mixing passage 100, the vacuum passage 98 communicates with the interior of the crankcase 132 of the engine through a connecting conduit or hose 134 and a check valve 136. Preferably, the check valve 136 communicates directly with the crankcase through a port 138 and is connected to one end of the hose 134, the other end of which is connected to the passage 98 or directly to the chamber 116 through a fitting 140 attached to the lid 82' or 82". If the fitting 140 communicates directly with the chamber 116, both the passage 98 and port 108 may be eliminated altogether. During cranking for starting and operation of the engine, sub-atmospheric or vacuum pulses and superatmospheric or pressure pulses are alternately created in the engine crankcase. During cranking and operating of the engine 130, the check valve 136 alternately opens to apply the sub-atmospheric pressure or vacuum pulses to the chamber 116 and diaphragm 122 or 122" and closes to prohibit the superatmospheric or positive pressure pulses from being applied to the chamber and diaphragm. In this way, during cranking and operation of the engine, the shut-off valve 16' is moved to and maintained in its open position to supply fuel from the gas tank to the fuel chamber 34 through the needle valve 41. When the engine is turned off or otherwise stops operating, the pressure in the crankcase 132 returns to essentially atmospheric pressure as in turn does the pressure in the chamber 116 so that the spring biased fuel shut off valve 16' closes.

FIG. 9 also illustrates a bowl vent shut-off valve 150 shown in an off or closed position. Valve 150 is utilized in all of the previously described embodiments and intersects a vent passage 152 which communicates, between the fuel chamber 34 and the atmosphere via an orifice 154 disposed near the fuel-and-air mixing passage inlet 104. A ball 156 of the valve 150 vibrates and dances within a counterbore 158 carried by the carburetor body 38 when the engine is running. This constitutes an open position of the valve 150. When the engine is not running, the ball 156 seals or rests, via gravity, against a seat insert 160 press fitted into the counterbore 158 from beneath.

While the forms of the invention herein disclose constitute presently preferred embodiments, many others are possible. It is not intended herein to mention all the possible equivalent forms or ramifications of the invention. It is understood that the terms used herein are merely descriptive rather than limiting and that various changes may be made without departing from the spirit or scope of the invention.

What is claimed is:

1. An emission control apparatus for a combustion engine having a carburetor, the emission control apparatus comprising:

a carburetor body having a valve seat;

a fuel bowl carried by the carburetor body, the fuel bowl defining a fuel chamber;

a fuel-in passage defined by the carburetor body, the fuel-in passage extending between an external carburetor fuel inlet and an inlet aperture defined by the valve seat;

a fuel-out passage defined by the carburetor body, the fuel-out passage communicating with the fuel chamber;

a float valve disposed within the fuel chamber, the float valve constructed and arranged to close the fuel-out passage when the fuel chamber contains sufficient fuel and to open the fuel-out passage when the fuel chamber contains insufficient fuel;

a recess defined by the valve seat, the inlet aperture and the outlet aperture each communicating with the recess; and a valve head disposed in the recess, the head having an on position and an off position, wherein the inlet aperture is in communication with the outlet aperture via the recess when the head is in the on position, and wherein the inlet aperture is obstructed by the head from being in communication with the outlet aperture when the head is in the off position.

2. The emission control apparatus set forth in claim 1 further comprising a spring constructed and arranged to bias the head in the off position, the spring having a first end portion engaged to the head and a second end portion engaged to the carburetor body.

3. The emission control apparatus set forth in claim 2 wherein the spring has a coil portion engaged between the first and second end portions.

4. The emission control apparatus set forth in claim 3 wherein the first end portion of the spring is engaged directly to the head.

5. The emission control apparatus set forth in claim 4 further comprising a fastener and a lid, the lid engaged to the carburetor body by the fastener, the recess being defined between the lid and the seat of the carburetor body.

6. The emission control apparatus set forth in claim 5 wherein the second end portion of the spring is engaged directly to the lid.

7. The emission control apparatus set forth in claim 6 wherein the recess is a bore defined by the carburetor body and the seat defines the bottom of the bore.

8. The emission control apparatus set forth in claim 7 wherein the head rotates between the on and off positions about a centerline.

9. The emission control apparatus set forth in claim 8 wherein the coil portion of the spring is cylindrical and is disposed concentrically about the centerline.

10. The emission control apparatus set forth in claim 9 wherein the lid has a cylindrical stud disposed concentrically about the centerline and projected toward the seat.

11. The emission control apparatus set forth in claim 10 wherein the coil portion of the spring is substantially disposed radially outward from the stud.

12. The emission control apparatus set forth in claim 11 further comprising:

the head having a cylindrical portion having a planar bottom surface which faces and is rotationally orientated to the seat of the carburetor body; and the planar bottom surface defining an elongated bottom channel having a first end communicating with the inlet aperture and an opposite second end communicating with the outlet aperture when the head is in the open position, and wherein the inlet and outlet apertures are obstructed from communication with the recess by the planar bottom surface of the cylindrical portion when the head is in the off position.

13. The emission control apparatus set forth in claim 12 wherein the head has a blind bore communicating axially upward, the coil portion of the spring being disposed concentrically within the cylindrical portion.

14. The emission control apparatus set forth in claim 13 further comprising:

an arm radially projecting outward from the cylindrical portion; and the carburetor body having a slot extending circumferentially about the centerline, the arm projecting through the slot.

15. The emission control apparatus set forth in claim 14 further comprising:

the arm having a distal end; and a push-pull cable engaged to the distal end of the arm, the push-pull cable for moving the shut-off valve from the off to the on position against the bias of the spring.

16. The emission control apparatus set forth in claim 15 further comprising:

the head having an outward surface and an outward channel, the outward surface defining the outward channel; and the first end portion of the spring disposed in the outward channel.

17. The emission control apparatus set forth in claim 16 further comprising:

the lid having a minor protrusion projecting parallel to the major protrusion and disposed radially outward from the coil portion of the spring; and the second end portion of the spring projecting tangentially outward from the coil portion to engage the minor protrusion of the lid.

18. The emission control apparatus set forth in claim 17 wherein the first end portion of the spring is a straight portion projecting radially inward from the coil portion and being disposed perpendicular to and intersecting the centerline.

19. The emission control apparatus set forth in claim 18 further comprising a gasket disposed in the recess and between the seat of the carburetor body and the head, the gasket being sealably engaged to the seat and in sealable contact with the head, the gasket having two holes being in respective communication with the recess at one end and the respective inlet and outlet apertures at the other end.

20. The emission control apparatus set forth in claim 19 wherein the slot is defined between the lid and the carburetor body.

21. The emission control apparatus set forth in claim 6 wherein the spring is a coiled spring.

22. The emission control apparatus set forth in claim 21 further comprising:

the head being carried by a resilient diaphragm;

the recess having an outer chamber and an inner chamber, the outer chamber defined between the lid and the diaphragm, the inner chamber defined between the seat and the diaphragm, the spring disposed in the outer chamber, the inlet and outlet apertures communicating with the inner chamber; and a vacuum passage communicating between the outer chamber and a vacuum source of the engine thereby enabling the spring to axially compress, moving the diaphragm from the off position to the on position when the pressure within the inner chamber is sufficiently greater than the pressure within the outer chamber to overcome the biasing force of the spring.

23. The emission control apparatus set forth in claim 22 further comprising:

a fuel-and-air mixing passage having an inlet and an outlet; and the vacuum passage extending between a vacuum port and a vacuum orifice, the vacuum port being carried by the lid and communicating with the outer chamber and the vacuum orifice being defined by the carburetor body and disposed at the vacuum source which is taken near the outlet of the fuel-and-air mixing passage.

24. The emission control apparatus set forth in claim 23 wherein the recess, the inlet aperture and the spring are concentrically disposed about a centerline, the diaphragm being engaged sealably to the inlet aperture when the shut-off valve is in the off position.

25. The emission control apparatus set forth in claim 24 wherein the diaphragm has a unitary seal tab projecting radially outward beyond the recess and being engaged between the lid and the carburetor body, and wherein the vacuum passage communicates through the seal tab.

26. The emission control apparatus set forth in claim 25 wherein the head is a unitary cone portion disposed concentrically about the centerline and projecting sealably into the inlet passage when the shut-off valve is in the off position.

27. The emission control apparatus set forth in claim 26 further comprising an intermediate member engaged between the carburetor body and the lid, the intermediate member defining the seat, the recess defined between the lid and the intermediate member, and the inlet, the outlet, and the vacuum passages extending through the intermediate member.

28. The emission control apparatus set forth in claim 27 wherein the diaphragm has a circumferential perimeter engaged between the lid and the intermediate member.

29. The emission control apparatus set forth in claim 22 wherein the vacuum passage communicates between the outer chamber and within a crankcase of the engine, the vacuum passage being defined by a hose engaged between the lid and the crankcase, and the hose communicates with a check valve which opens when the pressure in the outer chamber is substantially greater than the pressure in the crankcase.

30. The emission control apparatus set forth in claim 1 further comprising:

a vent passage carried by the carburetor body and communicating between the fuel chamber and the atmosphere; and a vent shut-off valve insecting the vent passage, the vent shut-off valve having a counterbore carried by the carburetor body, a ball disposed within the counterbore and a seat insert disposed within the counterbore below the ball and engaged sealably to the carburetor body.

31. An emission control apparatus for an internal combustion engine having a carburetor, the emission control apparatus comprising:

a carburetor body having a recess, a fuel inlet aperture, a fuel outlet aperture and each aperture communicating with the recess;

a fuel chamber carried by the carburetor body, the fuel chamber being exposed to atmospheric pressure;

a lid covering the recess and carried by the carburetor body;

a valve head disposed rotatably in the recess about a centerline and having an on position and an off position, the head having an arm projecting radially outward beyond the recess and through a circumferential slot in the carburetor body, the arm being constructed and arranged to move between opposite ends of the slot thereby positioning the valve head in either the on or off position;

an external fuel tank at near atmospheric pressure and being elevated above the fuel chamber;

a fuel-in passage defined by the carburetor body and communicating between the external fuel tank and the recess through the fuel inlet aperture;

a fuel-out passage defined by the carburetor body and communicating between the fuel chamber and the recess through the outlet aperture;

the inlet aperture communicating with the outlet aperture when the valve head is in the on position and the inlet aperture not communicating with the outlet aperture when the valve head is in the off position; and a push pull cable connected to a distal end of the arm to move the valve head to the on and off position.

32. The emission control apparatus set forth in claim 31 wherein the push-pull cable is engaged between a safety handle and the arm of the shut-off valve.

33. The emission control apparatus set forth in claim 32 wherein the push-pull cable is spliced into a valve engagement end and an ignition engagement end, the valve engagement end engaged to the distal end of the arm and the ignition engagement end arranged and constructed to engage an ignition cut-off switch.

34. The emission control apparatus set forth in claim 33 wherein the safety handle has a run and a shut-off position, the safety handle being manually engaged by the user when the engine is running, and disengaged when the engine is not running, the safety handle being spring biased in the shut-down position, and wherein the head is in the off position when the safety handle is in the shut-down position.

* * * * *